US006435937B1

(12) United States Patent
Naegele

(10) Patent No.: US 6,435,937 B1
(45) Date of Patent: Aug. 20, 2002

(54) TOY FIGURE WITH FORCE MEASUREMENT AND AUDIBLE MESSAGES

(75) Inventor: Michael A. Naegele, Saginaw, MI (US)

(73) Assignee: Phillip E. Naegele, Montrose, MI (US)

( * ) Notice: Subject to any disclaimer, the term of this patent is extended or adjusted under 35 U.S.C. 154(b) by 0 days.

(21) Appl. No.: 09/767,119

(22) Filed: Jan. 22, 2001

(51) Int. Cl.[7] ..... A63H 3/28

(52) U.S. Cl. ..... 446/298; 446/297; 446/369; 482/83

(58) Field of Search ..... 446/297, 369, 446/298, 299, 300, 301, 302; 482/83, 84, 86–90; 434/247, 258

(56) References Cited

U.S. PATENT DOCUMENTS 4,088,315 A * 5/1978 Schemmel ..... 482/4
4,974,833 A * 12/1990 Hartman et al. ..... 273/445
5,280,905 A * 1/1994 Micco ..... 473/444
5,716,302 A * 2/1998 Andersson ..... 482/83
5,816,885 A 10/1998 Goldman et al.

FOREIGN PATENT DOCUMENTS

SU 1602575 A1 10/1990

* cited by examiner

*Primary Examiner*—Jacob K. Ackun
*Assistant Examiner*—Bena B. Miller
(74) *Attorney, Agent, or Firm*—Reising, Ethington, Barnes, Kisselle, Learman & McCulloch, P.C.

(57) ABSTRACT

The toy figure has at least two force sensors. The total force applied to all the sensors by a person is measured by a force measuring device. One or more force measuring device output signals are sent to a data bus. Data bus signals are sent to a microcontroller. The microcontroller identifies a message group based on the maximum force signal received from the data bus and filters out data bus outputs that result from secondary force measuring device signals. The microcontroller sends a message group identification signal to the information storage device. The storage device broadcasts one of a plurality of messages from the message group.

6 Claims, 4 Drawing Sheets

TOY FIGURE WITH FORCE MEASUREMENT AND AUDIBLE MESSAGES

TECHNICAL FIELD

The toy figure has pressure sensors that measure the force applied, a microcontroller, that selects an audible message group that corresponds to the force applied, and an information storage device that plays a selected audible message from the message group.

BACKGROUND OF THE INVENTION

Machines are known that measure strength. One of these machines has a ball that is accelerated upward along a track by striking a lever with a large mallet. The maximum height attained by the ball represents the force exerted by the large mallet.

Machines with levers that are struck by a person's fist are also known. Some of these machines have a pad that is displaced when struck by a person's fist. The displacement of the pad is measured to determine the strength of the blow that was struck. Another machine accelerates a plate member upward along a track in response to being struck by a person's fist. The maximum height of the plate indicates the, force exerted by the blow. The fact that the ball, the plate or the pad were displaced a specific distance have no real meaning except that the distance can be compared to the distance obtained by another person using the same apparatus.

Dolls and other devices are available that make sounds when pressure is applied in different locations. Making the different sounds by applying pressure to a doll can be more fun for a child than striking the keys on a piano. However, the force applied to make the sound is not measured.

Numerous devices have been devised to measure the force applied to punching bags, martial arts training devices and training dummies for various contact sports. These devices are in some cases very expensive. Data concerning the force applied is usually provided. This data is generally visually displayed. Sometimes the display is on a computer printout or screen.

Dolls are available which provide an audible message in response to a predetermined signal. The signal is generally based upon the location on the doll where pressure is applied. The force applied is not considered as long as it is sufficient to trigger an audible response. A device for measuring force is not employed with such dolls.

SUMMARY OF THE INVENTION

The toy figure is a doll that has some resemblance to a known person. This person could be a well known wrestler, an Olympic weight lifter, a boxer, a football player or possible a politician. The doll houses a force measuring device and has multiple locations in which force can be applied. The trunk area can be squeezed and the hands or arms can be squeezed. Force applied to the feet or legs could also be measured.

The force measuring device measures the force applied to one or more of the sensors in the force applying positions. A signal is generated that indicates the maximum force applied. The signal is received by a data bus. The data bus sends signals to a microcontroller. The microcontroller sends instructions to an information storage device. The information storage device plays an audible message that indicates the force applied and plays one of a plurality of recorded messages. The recorded message that is played is appropriate for the force measured. Preferably there are five or so messages for each message group that represents a range of applied forces. One of these five messages is played each time a specific force range is attained. Once all five or so messages from one message group are played, the information storage device starts over and repeats messages.

BRIEF DESCRIPTION OF THE DRAWINGS

These and other features and advantages of the present invention will become readily appreciated when considered in connection with the following detailed description and appended drawings, wherein.

DETAILED DESCRIPTION OF THE PREFERRED EMBODIMENT

Figure 1:
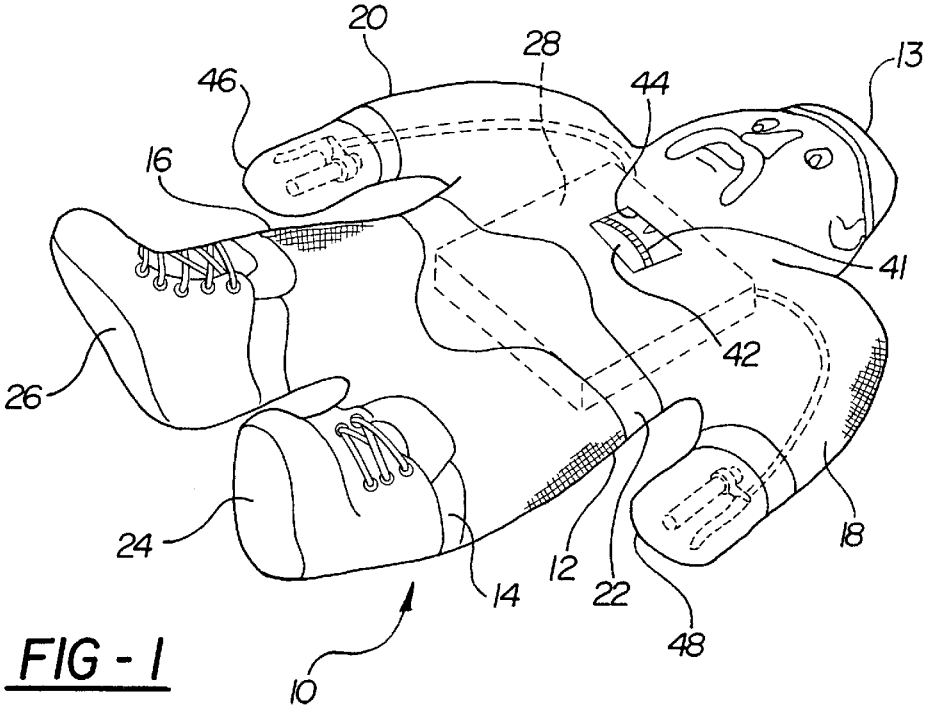
FIG. 1 is a perspective view of the toy figure with the force sensor and the force measuring device shown in hidden lines.

The toy novelty FIG. 10 as shown in FIG. 1 has a trunk 12, a head 13, legs 14 and 16 and arms 18 and 20. A wrestling championship belt 22 encircles the waist area of the trunk 12 as shown. Small boots 24 and 26, similar to those worn by wrestlers, are attached to the feet. The appearance could be changed as desired without changing the function of the toy novelty FIG. 10.

A force measuring device 28 is mounted in the chest area of the trunk 12 of the FIG. 10. A signal generator is associated with the force measuring device 28. A signal that is proportional to a force applied to the FIG. 10 is generated and transmitted to a data bus 30. The data bus 30 sends a signal, that is proportional to the force applied to the figure, to a microcontroller 32. The microcontroller 32 sends instructions to an information storage device 34. The information storage device 34 plays one of several audible messages that corresponds to the fore measured by the force measuring device 28. The data bus 30, the microcontroller 32 and the information storage device 34 are all mounted in the FIG. 10.

The force measuring device 28 as shown is a common bathroom scale. The scale includes a case 36 and a top cover 38. The top cover 38 sets on a linkage and springs. A force that urges the cover 38 toward the case 36 deforms the spring or springs, moves the cover toward the base and rotates a shaft 40 about a shaft axis 39. A disk 42 is fixed to the shaft 40 and rotates with the shaft. Numbers and a scale 41 printed on one side of the disk indicate the force that is applied to the top cover 38. An optional aperture 44 in the chest area of the trunk 12 exposes the disk 42 and permits a person to visually determine how much force is applied. If desired, a person can be weighed by standing on the trunk 12 over the top cover 38. A number of different scales can be used in place of the measuring device 28 that is described above and shown in the drawing.

Figure 2:
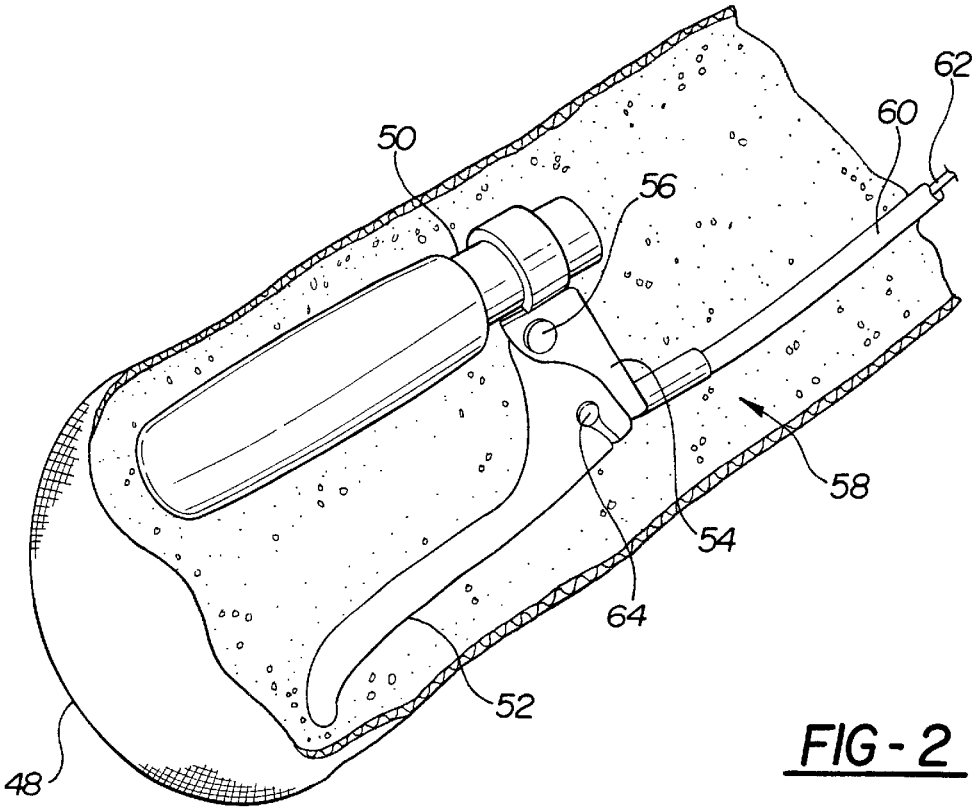
FIG. 2 is an enlarged view, with parts broken away, showing a force sensor unit in an extremity.
Figure 3:
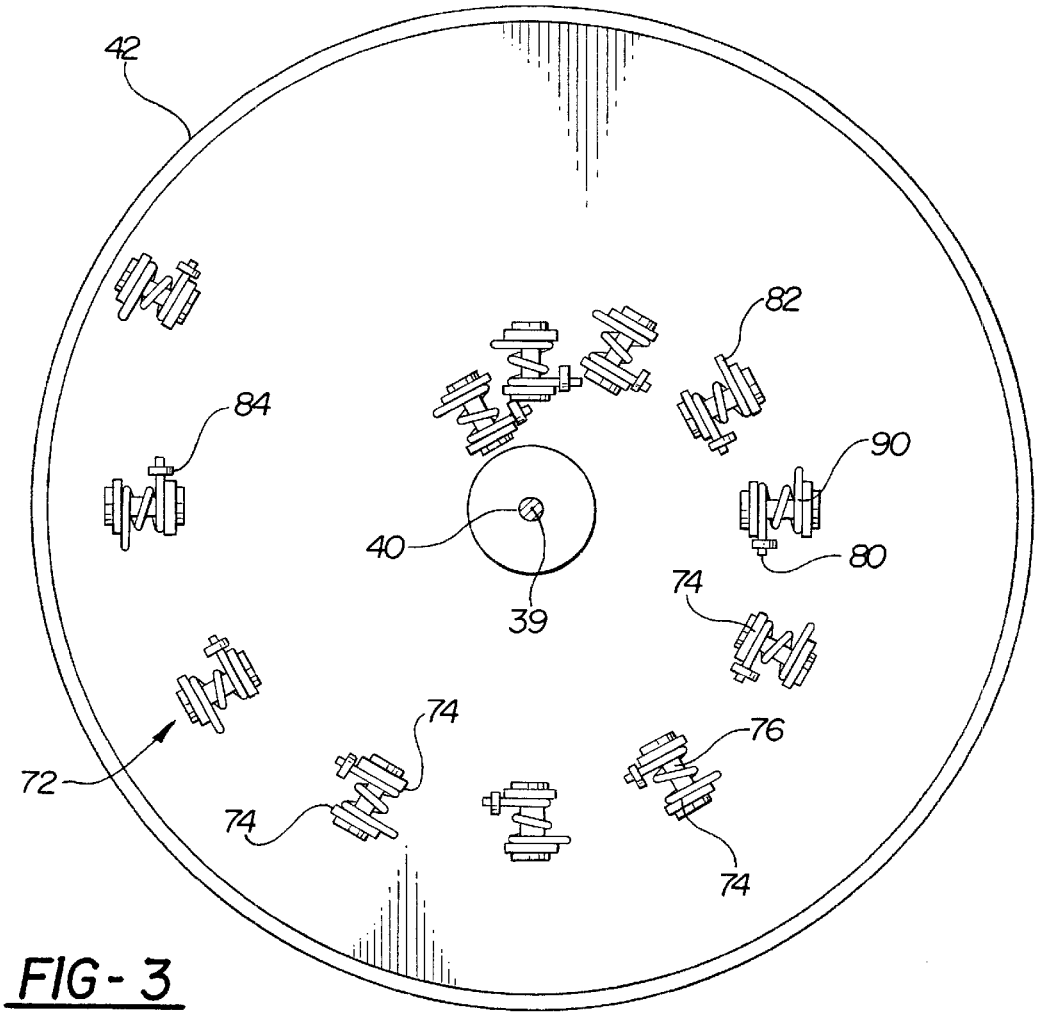
FIG. 3 is a plan view of one way switch actuators on the underside of a force measuring device indicator disk.

A force may be applied to the top cover 38 by squeezing the trunk 12. Force can also be applied by squeezing the hand areas 46 and 48. Each hand area 46 and 48 has a sensor that includes a bicycle hand brake device with a fixed bar 50 and a lever 52. The lever 52 is pivotally attached to a support bracket 54 by a pivot pin 56. The support bracket 54 is fixed to the fixed bar 50. A bowden wire assembly 58 includes a sheath 60 and a cable 62. One end of the sheath 60 abuts the support bracket 54. An end of the cable 62 is attached to the lever 52 by a cable anchor pin 64. Pivoting the lever 52 clockwise about the pivot pin 56 as shown in FIG. 2 pulls the cable 62 from the sheath 60. A second end of the sheath 60 abuts a flange 66 on the top cover 38 of the force measuring device, 28. The other end of the cable 62 passes through the flange 66, around a pulley 68 journalled on a bracket 70 fixed to the top cover 38, and is anchored to the case 36 by a sleeve 71. When the cable 62 is pulled from the sheath 60 by the lever 52, it is also pulled around the pulley 68 and into a second end of the sheath. This moves the top cover 38 toward the case 36 and exerts a force on the force measuring device 28. Both bowden wire assemblies 58 work the same way. Force can be applied to one of the assemblies 58 or to both assemblies simultaneously.

Force applied to sensors in the legs 14 and 16, the head 13 or other parts of the novelty FIG. 10 can be transferred to the force measuring device 28 by a bowden wire assembly 58. Force could also be transferred by hydraulic fluid. A pump could be placed in each area where force is applied and fluid moved by the pump could act on a linear actuator attached to the force measuring device 28. The pump can be a mere fluid bladder. The force measuring device 28 measures the force that is applied to all sensors simultaneously.

The force applied to the force mesuring device 28 rotates the shaft 40 and the disk 42. A number of one way switch activators 72 are mounted on the bottom of the disk 42. The activators 72 are spaced radially from the shaft 40 and spaced apart from each other radially a uniform distance. Switch activators 72 are also spaced angularly around the shaft 40 from each other. Each activator includes a pair of mounting brackets 74 fixed to the bottom of the disk 42. A pivot pin 76 is supported by each pair of mounting brackets 74 with its axis parallel to the disk and extending radially from the shaft 40. A lever 78 with a stop arm 80 and a cam arm 82 is journalled on the pivot pin 76. A spring 84 attached to the disk 42 acts on the stop arm 80 and urges the lever 78 in a clockwise direction as shown in FIGS. 6*a* and 6*b*.

Figure 6A:
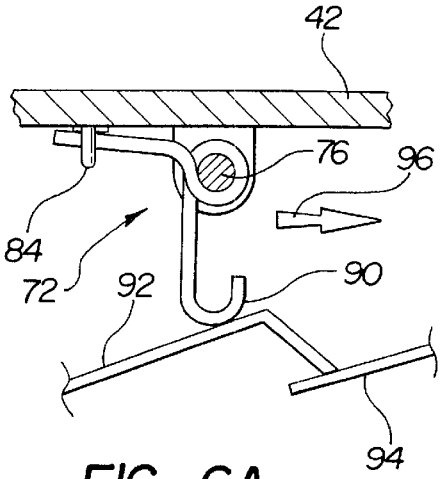
FIG. 6*a* is an enlarged side elevational view of one of the one way switch activators closing switch contacts.
Figure 6B:
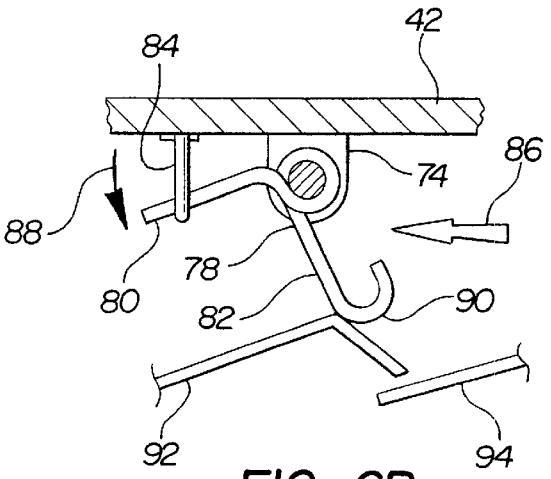
FIG. 6*b* is an enlarged side elevational view of one of the one way switch activators moving past switch contacts without closing a circuit.

The switch activator 72 and the disk 42 move in the direction indicated by the arrow 86 in FIG. 6*b* when force on the force measuring device 28 is increasing. The weak spring 84 permits the lever 78 to pivot counterclockwise, as indicated by the arrow 88, upon contact between the cam surface 90 and a movable electrical contact member 92. The switch activator 72 passes over the contact member 92 without forcing the movable contact member into contact with the adjacent fixed electrical contact member 94.

A decrease in the force on the force measuring device permits a spring or springs to start to rotate the disk 42 and the switch activator 72 in the direction indicated by arrow 96 in FIG. 6*a*. Upon contact between the cam surface 90 and the contact member 92, the stop arm 80 contacts the disk 42 and prevents further clockwise movement of the switch activator 72 about the pivot pin 76. Further movement of the activator 72 and the disk 42 in the direction of the arrow 96 results in the cam surface 90 forcing the movable electrical contact 92 into contact with the adjacent fixed electrical contact member 94. Contact between the member 92 and the member 94 closes a circuit. When the force applied to the force measuring device 28 is increasing, the activator 72 past the contact members 92 and 94 and leave all the circuits open. Upon a decrease in the force applied to the force measuring device 28, the last movable contact member 92 that was past over by one of the switch activators 72 without closing a circuit will be the first movable contact member to be cammed into contact with an adjacent fixed electrical contact member 94 to form a closed circuit. The first closed circuit will indicate the maximum force applied to the force measuring device 28 and will be the first electrical signal transmitted to the data bus 30. The data bus 30 sends signals to the information storage device 34 that corresponds to the first signal received from one of the switch activators. The switch activators 72 that passed over movable contact members 92 earlier will subsequently close open circuits. The signals that result from these subsequently closed circuits are filtered out by the microcontroller 32.

Figure 4:
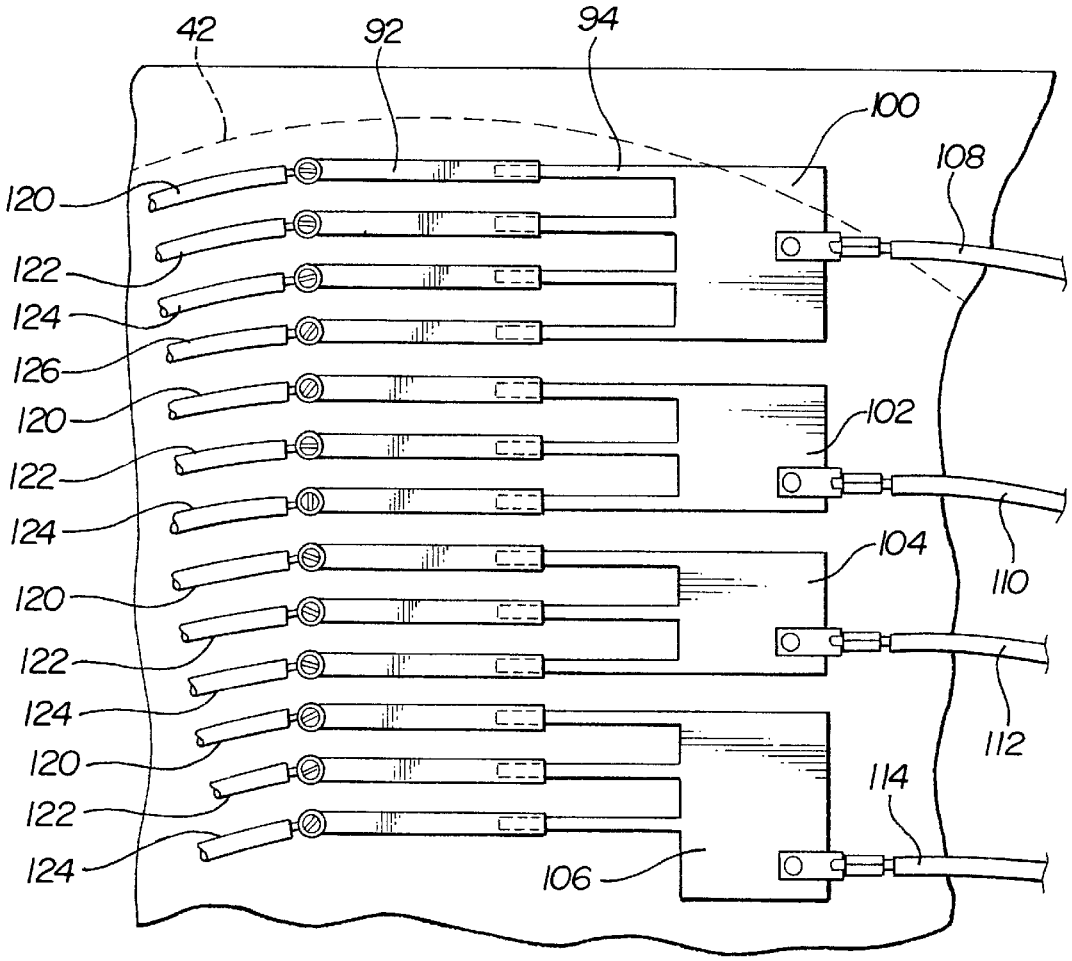
FIG. 4 is a plan view of the switch contacts that are activated by the one way switch activators.
Figure 5:
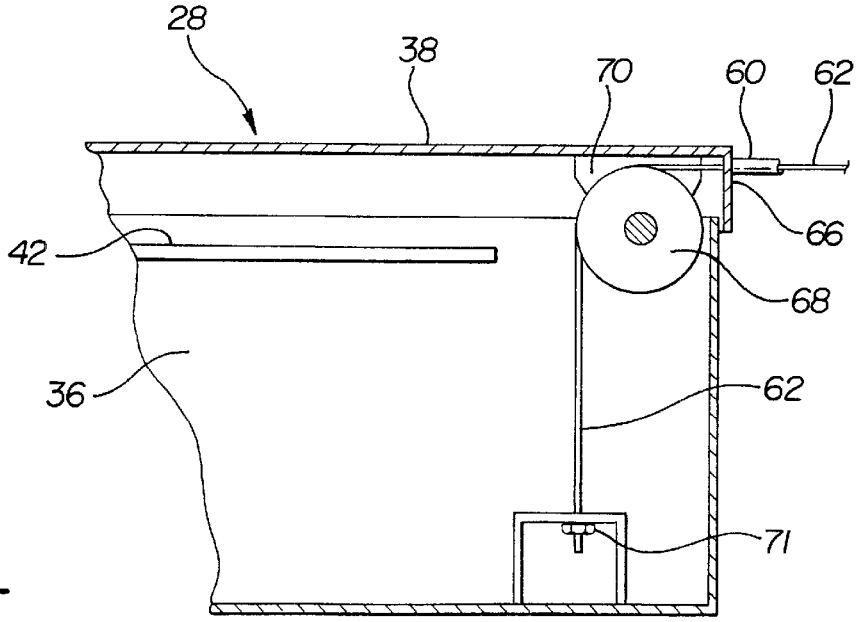
FIG. 5 is a schematic view of a bowden wire connection to the force measuring device with parts broken away.
Figure 7:
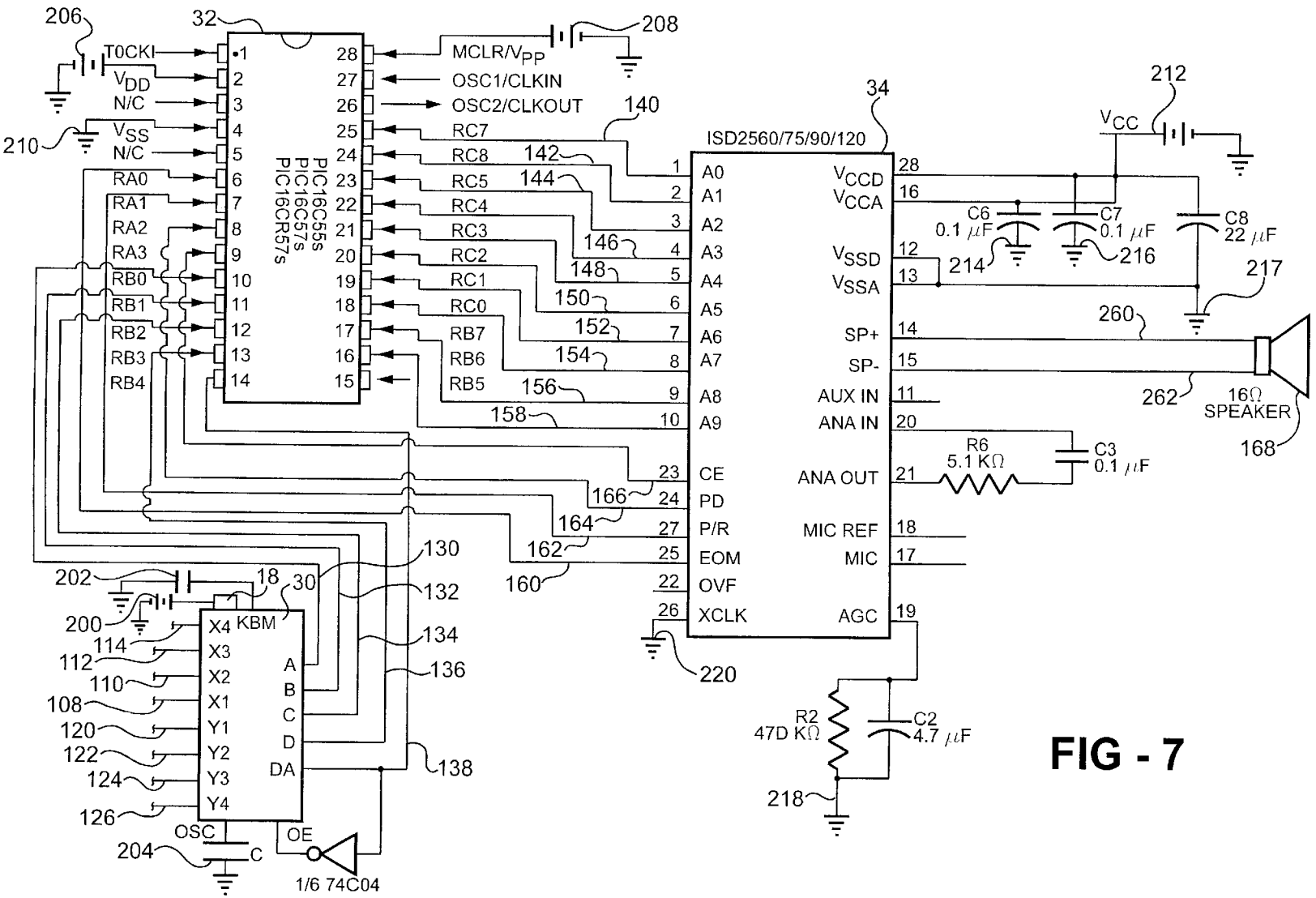
FIG. 7 is a circuit diagram.

The fixed electrical contact members 94 are connected to four separate plate members 100, 102, 104 and 106 as shown in FIG. 4. The plate member 100 is connected to the data entry bus port X1 by lead 108. The plate member 102 is connected to the data entry bus port X2 by lead 110. The plate member 104 is connected to the data entry bus port X3 by lead 112. The plate member 106 is connected to the data entry bus port X4 by lead 114.

Data entry bus port Y1 is connected to four movable electrical contact members 92 by leads 120. Data entry bus port Y2 is connected to four movable electrical contact members 92 by leads 122. Data entry bus port Y3 is connected to four movable electrical contact members 92 by leads 124. Data entry bus port Y4 is connected to one electrical contact member 92 by lead 126. Note that the data entry bus port Y4 is capable of handling three more leads 126 and three more switch activators 72 if desired.

The data entry bus 30 has five pins A, B, C, D and DA connected respectively to pins RB0, ROB1, RB2, RB3 and RB4 of a microcontroller 32 by leads 130, 132, 134, 136 and 138. These five pairs of pins are capable of sending and receiving sixteen messages.

Pins RC7, RC6, RC5, RC4, RC3, RC2, RC1, RC0, RB7, and RB6 on the micrcontroller 32 are connected respectively to the pins A0–A9 on the information storage device 34 by leads 140–158.

Pins RA0, RA1, RA2, and RA3 on the microcontroller 32 are connected respectively to pins 25, 27, 24 and 23 on the information storage device 34 by leads 160, 162, 164 and 166.

The information storage device 32 has an audio speaker 168 that is mounted inside the novelty toy FIG. 10 in a protected position. Leads 260 and 262 from the speaker 168 are connected to ports 14 and 15 on the information storage device 34.

The data bus 30, the microcontroller 32 and an information storage device 34 are powered by five volt direct current batteries. A five volt source 200 is connected to port 18 on the data entry bus 30. Ports KBM and OSC on the data entry bus 30 are grounded through capacitors 202 and 204. A five volt power source 206 is connected to a port 2 on the microcontroller 32. A second five volt power source 208 is connected to a port 28 of the microcontroller 32. The microcontroller 32 port 4 is connected to a ground 210. The ports 28 and 16 of the information storage device 34 are connected to a five volt power source 212. Ports 12, 13, 19 and 26 of the information storage device 34 are connected to grounds 214, 216, 217, 218 and 220. Capacitors C6, C7 and C8 are provided in the leads connected to grounds 214, 216 and 217 respectively. A capacitor C2 is connected in parallel with a resistor R2 in the lead to ground 218. Ports ANA IN and ANA OUT in the information storage device 34 are connected by a circuit including a capacitor C3 in series with a resistor R6. A single five volt battery can supply current to the data bus 30, the microcontroller 32 and the information storage device 34 if desired.

As described above the entire system including the power source or sources is contained in the FIG. 10. When used for the intended use, the FIG. 10 will be subjected to numerous outside forces. As a result, the useful life of the FIG. 10 may be relatively short. The data entry bus 30, the microcontroller 32, the information storage device 34 minus the speaker 168 and the power supply can be mounted in a separate control box and attached to the FIG. 10 by an umbilical cord. The umbilical cord in this arrangement connects the separate control box to the movable electrical contact members 92, the fixed electrical contact members 94 and the speaker 168.

The first movable contact member 92 that contacts a fixed electrical contact member 94 selects a message group that corresponds to a force applied to the FIG. 10. The information storage device 34 then plays one of several recorded messages that correspond to the force applied to the FIG. 10. A plurality of recorded messages preferably includes at least five different messages. One of the five messages from the message group is played each time the message group is activated. The next message in a message group is played the next time that message group is activated. After all the messages in a message group have been played, the information storage device will start over with the first message the next time that particular message group is activated. After a short delay following the broadcast of a recorded message, the microcontroller 32 is reset and the system is ready to receive another force input from the sensors in the toy FIG. 10.

Obviously, many modifications and variation of the present invention are possible in light of the above teachings. It is, therefore, to be understood that within the scope of the appended claims, the invention may be practiced otherwise than as specifically described. The invention is defined by the claims.

What is claimed is:

1. A toy figure comprising:

a body with a trunk, a head and extremities;

a plurality of force sensors positioned in the body in positions to sense forces manually applied to the toy figure;

a force measuring device inside the body and connected to said plurality of sensors, that receives forces applied to the sensors and measures the magnitude of forces;

wherein said force measuring device includes a rotatable disk and a plurality of switches that close a circuit corresponding to the largest force applied to the plurality of force sensors;

wherein each of the plurality of switches includes a pair of electrical contacts and a switch activator and each of the plurality of switches is radially spaced, relative to an axis of rotation of the rotatable disk, from the other switches;

wherein the switch activator of each of the plurality of switches is mounted on the rotatable disk, slides over the pair of electrical contacts when carried past the pair of electrical contacts and a force exerted on said force measuring device is increasing and wherein the switch activator of each of the plurality of switches cams the pair of electrical contacts to a closed circuit position when carried past the pair of electrical contacts and the force exerted on said measuring device is decreasing;

a data bus, connected to said force measuring device, for generating a data bus output that corresponds to the largest force applied to one or more of said plurality of sensors and measured by the force measuring device;

a microcontroller, connected to the data bus, that receives the data bus output and generates a message group signal that corresponds to the data bus output; and an information storage device that stores a plurality of messages in each of a plurality of message groups and upon receipt of the message group signal from said microcontroller broadcasts an audio message from a selected message group that corresponds to the message group signal.

2. A toy figure as set forth in claim 1 wherein said data bus transmits a data bus output to said microcontroller that corresponds to a first signal received from said force measuring device.

3. A toy figure as set forth in claim 1 wherein said information storage device stores at least five different messages for each of said plurality of message groups, and wherein after all of the messages in one of said plurality of message groups has been broadcast, said information storage device repeats one of the messages in response to subsequent application of the same force to said body.

4. A toy figure as set forth in claim 1 wherein the force measuring device is a spring and linkage force measuring device.

5. A toy figure comprising:

a body with a trunk, a head and extremities;

a plurality of force sensors positioned in the body in positions to sense forces manually applied to the toy figure;

a force measuring device inside the body and connected to said plurality of sensors including a common spring and linkage mechanical scale that rotates a disk and shaft about a shaft axis to measure the total force applied to at least one of said plurality of sensors;

a plurality of switches each of which has a pair of electrical contacts and a plurality of switch activators mounted on the disk and wherein at least one of the switch activators initiates contact between the pair of electrical contacts and generates a first electric signal that corresponds to the largest force exerted on the force measuring device by the plurality of force sensors, upon a reduction of force exerted upon said force measuring device;

a data bus, connected to said force measuring device, which receives the electric signal from the force measuring device, and produces a data bus output that corresponds to the electric signal from the force measuring device;

a microcontroller, connected to the data bus, that receives the data bus output and produces a message group output that corresponds to the maximum force exerted upon said force measuring device; and an information storage device that stores a plurality of sequential messages in each of a plurality message groups and upon receipt of a message group output from said microcontroller broadcasts one of the plurality of sequential messages in a message group corresponding to the message group output and wherein after all of the plurality of sequential messages in a given message group have been broadcast, said information storage device repeats one of the plurality of sequential messages upon receiving the message group output for the given message group.

6. A toy figure comprising:

a body with a trunk, a head and extremities;

a plurality of force sensors positioned in the body in positions to sense forces manually applied to the toy figure;

a force measuring device inside the body and connected to said plurality of sensors, that receives forces applied to the sensors and measures the magnitude of forces;

wherein said force measuring device includes a rotatable disk and a plurality of switches that close a circuit corresponding to the largest force applied to the plurality of force sensors;

wherein each of the plurality of switches includes a pair of electrical contacts and a switch activator and each of the plurality of switches is radially spaced, relative to an axis of rotation of the rotatable disk, from the other switches;

wherein the switch activator of each of the plurality of switches is mounted on the rotatable disk, slides over the pair of electrical contacts when carried past the pair of electrical contacts and a force exerted on said force measuring device is increasing and wherein the switch activator of each of the plurality of switches cams the pair of electrical contacts to a closed circuit position when carried past the pair of electrical contacts and the force exerted on said measuring device is decreasing;

a microcontroller receives a signal that corresponds to the largest force applied to one or more of said plurality of force sensors and generates a message group signal; and an information storage device that stores a plurality of messages in each of a plurality of message groups and upon receipt of the message group signal from said microcontroller broadcasts an audio message from a selected message group that corresponds to the message group signal.

* * * * *